US009311851B2

(12) United States Patent
Kaplan et al.

(10) Patent No.: US 9,311,851 B2
(45) Date of Patent: Apr. 12, 2016

(54) PIXEL CIRCUIT, DISPLAY DEVICE USING THE SAME, AND DISPLAY DEVICE DRIVING METHOD

(71) Applicant: Samsung Display Co., Ltd., Yongin (KR)

(72) Inventors: Leonid Kaplan, Yongin (KR); Heung-Yeol Na, Yongin (KR); Baek-Woon Lee, Yongin (KR); Won-Sik Hyun, Yongin (KR); Jae-Hoon Lee, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 14/256,411

(22) Filed: Apr. 18, 2014

(65) Prior Publication Data

US 2015/0015563 A1 Jan. 15, 2015

(30) Foreign Application Priority Data

Jul. 15, 2013 (KR) ..... 10-2013-0083017

(51) Int. Cl.
*G09G 3/32* (2006.01)
*G09G 3/20* (2006.01)

(52) U.S. Cl.
CPC ..... *G09G 3/3233* (2013.01); *G09G 3/2029* (2013.01); *G09G 3/2033* (2013.01); *G09G 2300/0809* (2013.01); *G09G 2320/0233* (2013.01)

(58) Field of Classification Search
None
See application file for complete search history.

(56) References Cited

U.S. PATENT DOCUMENTS 6,809,482 B2 10/2004 Koyama
2004/0257353 A1* 12/2004 Imamura ..... G09G 3/3233 345/204
2006/0023551 A1* 2/2006 Peng ..... G09G 3/3233 365/226
2007/0091030 A1* 4/2007 Drevillon ..... G09G 3/3233 345/76
2008/0231560 A1* 9/2008 Yamashita ..... G09G 3/3233 345/76
2013/0127932 A1* 5/2013 Han ..... G09G 3/3233 345/691

FOREIGN PATENT DOCUMENTS

KR 10-2005-0097006 10/2005
KR 10-2006-0114470 11/2006
KR 10-2008-0022696 3/2008

OTHER PUBLICATIONS

A. Tagawa et al., "A Novel Digital-Gray-Scale Driving Method with a Multiple Addressing Sequence for AM-OLED Displays," IDW, 2004, pp. 279-282.

* cited by examiner

*Primary Examiner* — Joseph Haley
*Assistant Examiner* — Emily Frank
(74) *Attorney, Agent, or Firm* — Cantor Colburn LLP

(57) ABSTRACT

A pixel circuit includes: an organic light emitting diode ("OLED"); a threshold circuit which generates an output signal based on an input signal, where the threshold circuit has a hysteresis characteristic with respect to the input signal; a first transistor including a first electrode connected to a data line, a second electrode connected to an input terminal of the threshold circuit, and a gate electrode connected to a scan line; and a second transistor including a first electrode connected to a first power, a second electrode connected to an anode of the organic light emitting diode, and a gate electrode connected to an output terminal of the threshold circuit, where the second transistor controls a current amount that flows to the organic light emitting diode from the first power based on the output signal of the threshold circuit.

10 Claims, 4 Drawing Sheets

FIG. 2

| SF | SF1 | SF2 | SF3 | SF4 | SF5 | SF6 | SF7-1 | SF7-2 | SF8-1 | SF8-2 | SF8-3 | SF8-4 |
|---|---|---|---|---|---|---|---|---|---|---|---|---|
| TIME | 1 | 2 | 4 | 8 | 16 | 32 | 32 | 32 | 32 | 32 | 32 | 32 |

PIXEL CIRCUIT, DISPLAY DEVICE USING THE SAME, AND DISPLAY DEVICE DRIVING METHOD

This application claims priority to Korean Patent Application No. 10-2013-0083017, filed on Jul. 15, 2013, and all the benefits accruing therefrom under 35 U.S.C. §119, the content of which in its entirety is herein incorporated by reference.

BACKGROUND (a) Field

Exemplary embodiments of the invention relate to a pixel circuit, a display device including the pixel circuit, and a method for driving the display device, and in particular, to a method for maintaining a voltage transmitted to a gate electrode of a driving transistor by effectively preventing an influence of a leakage current of a transistor.

(b) Description of the Related Art

Recently, various types of flat display devices, e.g., liquid crystal displays ("LCD"), field emission displays ("FED"), plasma display panels ("PDP") and an organic light emitting diode ("OLED") display, are widely used instead of cathode ray tubes ("CRT") having relatively heavy weight and large size.

Among the various types of flat panel display devices, the OLED display including an OLED that generates light by recombination of electrons and holes to display an image typically has a fast response speed with low power consumption, and has high luminous efficiency, high luminance, and large viewing angle.

In general, a plurality of pixels in the OLED display includes an OLED for emitting light, and the OLED generates light of a predetermined luminance corresponding to a data current supplied from a pixel circuit.

Digital driving, which is one grayscale expression method of the OLED display, controls a turn-on time of a pixel. In the case of the OLED display using the digital driving method, a unit frame is divided into a plurality of sub-frames, and a light emitting period of each sub-frame is appropriately set to display a gray. The pixel emits light during a sub-frame selected based on an image signal for grayscale expression among the sub-frames constituting one unit frame. That is, the sub-frame selected based on the image signal is turned on to express the grayscale.

Each of the pixels generally includes the OLED, a driving transistor for controlling a current amount flowing to the OLED, a storage capacitor for charging a voltage that corresponds to a data signal, and a compensation circuit for compensating a threshold voltage of the driving transistor.

Such pixels charge a voltage that corresponds to the threshold voltage of the driving transistor and the data signal into the storage capacitor, and supply a current that corresponds to the charged voltage to the OLED to display predetermined images. However, the voltage transmitted to a gate electrode of a transistor for controlling light emission of the OLED may not be maintained substantially constant due to noise such as a leakage current or a ripple that may occur as a characteristic of the transistor.

SUMMARY

Exemplary embodiments of the invention relate to a pixel circuit to maintain a voltage transmitted to a gate electrode of a driving transistor by effectively preventing an influence of a leakage current of a transistor in the pixel circuit, and to a display device including the pixel circuit to thereby display an image with substantially uniform luminance.

An exemplary embodiment of the invention provides a pixel circuit including: an organic light emitting diode ("OLED"); a threshold circuit which generates an output signal based on an input signal, where the threshold circuit has a hysteresis characteristic with respect to the input signal; a first transistor including a first electrode connected to a data line, a second electrode connected to an input terminal of the threshold circuit, and a gate electrode connected to a scan line; and a second transistor including a first electrode connected to a driving voltage, a second electrode connected to an anode of the OLED, and a gate electrode connected to an output terminal of the threshold circuit, where the second transistor controls a current amount which flows to the OLED from the driving voltage based on the output signal of the threshold circuit.

In an exemplary embodiment, the threshold circuit may output a low-level voltage when an input voltage is less than a second voltage, and the threshold circuit may output a high-level voltage when the input voltage is greater than the second voltage.

In an exemplary embodiment, the threshold circuit may output the high-level voltage when the input voltage exceeds a first voltage after the input voltage is increased to be greater than the second voltage, and the threshold circuit may output the low-level voltage when the input voltage is less than the first voltage.

In an exemplary embodiment, the threshold circuit may include at least one of a Schmitt trigger, a threshold detector and a zero level detector.

Another exemplary embodiment of the invention provides a display device including: a scan driver which generates a scan signal and supplies the scan signal to a scan line; a data driver which generates a data signal and supplies the data signal to a data line; a display including a pixel circuit connected to the scan line and the data line; and a controller which controls the scan driver and the data driver, where the pixel circuit includes an OLED, a threshold circuit which generates an output signal based on an input signal, where the threshold circuit has a hysteresis characteristic with respect to an input signal, a first transistor including a first electrode connected to the data line, a second electrode connected to an input terminal of the threshold circuit, and a gate electrode connected to the scan line, and a second transistor including a first electrode connected to a driving voltage, a second electrode connected to an anode of the OLED, and a gate electrode connected to an output terminal of the threshold circuit, where the second transistor controls a current amount which flows to the OLED from the driving voltage based on the output signal of the threshold circuit.

In an exemplary embodiment, the threshold circuit may output a low-level voltage when an input voltage is less than a second voltage, and the threshold circuit may output a high-level voltage when the input voltage is greater than the second voltage.

In an exemplary embodiment, the threshold circuit may output a high-level voltage when the input voltage exceeds the first voltage after the input voltage is increased to be greater than the second voltage, and the threshold circuit may output a low-level voltage when the input voltage is less than the first voltage.

In an exemplary embodiment, the threshold circuit may include at least one of a Schmitt trigger, a threshold detector and a zero level detector.

Another embodiment of the invention provides a method for driving a display device, the method including: outputting a low-level voltage from a threshold circuit of a pixel circuit of the display device when a voltage of an input signal to the threshold circuit is less than a second voltage; and outputting a high-level voltage from the threshold circuit when the voltage of the input signal to the threshold circuit becomes greater than the second voltage, where the pixel circuit includes an OLED, the threshold circuit which generates an output signal based on the input signal, where the threshold circuit has a hysteresis characteristic with respect to the input signal, a first transistor including a first electrode connected to a data line of the display device, a second electrode connected to an input terminal of the threshold circuit, and a gate electrode connected to a scan line of the display device, and a second transistor including a first electrode connected to a driving voltage, a second electrode connected to an anode of the OLED, and a gate electrode connected to an output terminal of the threshold circuit, where the second transistor controls a current amount which flows to the OLED from the driving voltage based on the output signal of the threshold circuit.

In an exemplary embodiment, the method may further include: outputting the high-level voltage from the threshold circuit when the voltage of the input signal exceeds the first voltage after the voltage of the input signal is increased to be greater than the second voltage; and outputting the low-level voltage from the threshold circuit when the voltage of the input signal is less than the first voltage.

According to exemplary embodiments of the invention, as described herein, the influence of the leakage current of the transistor in the pixel circuit is effectively prevented to maintain the voltage transmitted to the gate electrode of the driving transistor substantially constant. In such embodiments, the display device may display images with substantially uniform luminance.

BRIEF DESCRIPTION OF THE DRAWINGS

The above and other features of the invention will become more apparent by describing in further detail exemplary embodiments thereof with reference to the accompanying drawings, in which:

FIG. 2 a conceptual diagram showing sub-frames of a unit frame in an exemplary embodiment of a digital drive method according to the invention;

DETAILED DESCRIPTION

Figure 1:
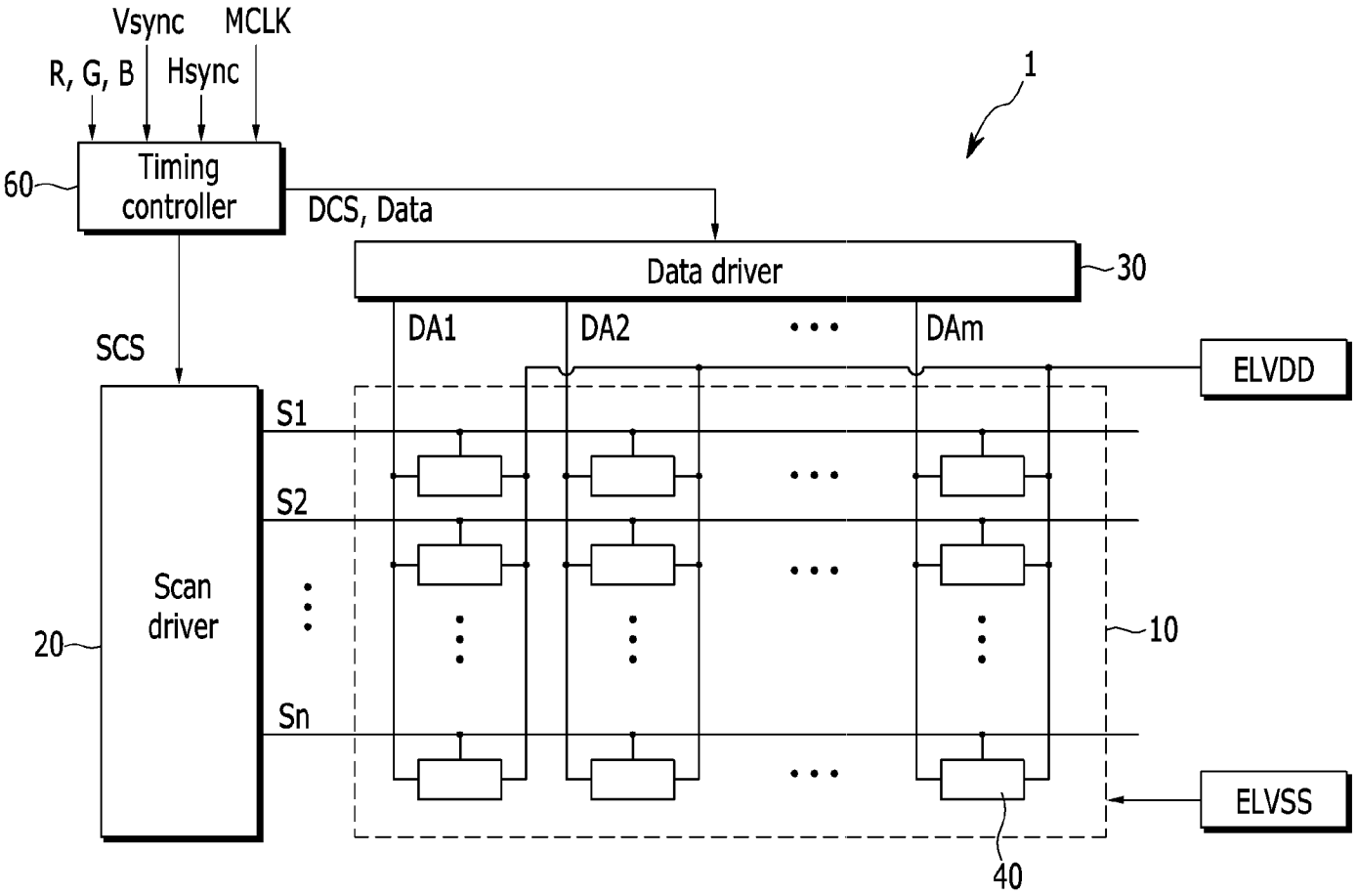
FIG. 1 is a block diagram showing an exemplary embodiment of a display device according to the invention.

The invention will be described more fully hereinafter with reference to the accompanying drawings, in which embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," "connected to" or "coupled to" another element or layer, the element or layer can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to accompanying drawings.

FIG. 1 is a block diagram showing an exemplary embodiment of a display device according to the invention.

Referring to FIG. 1, an exemplary embodiment of the display device 1 includes a display panel 10 including a plurality of pixels 40 connected to a plurality of scan lines (S1 to Sn) and a plurality of data lines (DA1 to DAm), a scan driver 20 that provides a scan signal to the pixels 40 through the scan lines (S1 to Sn), a data driver 30 that provides a data signal to the pixels through the data lines (DA1 to DAm), and a timing controller 60 that controls the scan driver 20 and the data driver 30. Here, n and m are natural numbers greater than 1.

The pixels 40 receive driving voltages, e.g., a first power (ELVDD) and a second power (ELVSS), from an external device. The pixels 40 provide a current to an organic light emitting diode ("OLED") based on corresponding data signals, and the OLED emits light with predetermined luminance based on the current.

The timing controller 60 receives video signals (R, G, B) provided from an external device, and receives an input control signal for controlling displaying of an image corresponding to the video signals. The video signals (R, G, B) have luminance information of the pixels included in the respective pixels 40, and the luminance information includes data for indicating a grayscale of the corresponding pixel from among a predetermined number, for example, $1024=2^{10}$, $256=2^{8}$, or $64=2^{6}$ grayscales. The input control signal includes a vertical synchronization signal (Vsync), a horizontal synchronization signal (Hsync), and a main clock signal (MCLK).

The timing controller 60 uses the video signals (R, G, B) and the input control signal to process the video signals (R, G, B) based on operational conditions of the display panel 10 and the data driver 30, and generates an image data signal (Data), a data control signal (DCS) and a scan control signal (SCS). The data control signal (DCS) from the timing controller 60 is supplied to the data driver 30, and the scan control signal (SCS) from the timing controller 60 is supplied to the scan driver 20.

The timing controller 60 divides a unit frame of the video signals (R, G, B) into a plurality of sub-frames (SF shown in FIG. 2), and determines driving methods of the pixels 40.

FIG. 2 is a conceptual diagram showing sub-frames of a unit frame in an exemplary embodiment of a digital drive method according to the invention.

The unit frame is divided into the sub-frames of FIG. 2 arranged in order from a sub-frame 1 (SF1) to a sub-frame 8-4 (SF8-4). In such an embodiment, the sub-frames are arranged in an ascending order of sub-frame 1 (SF1), sub-frame 2 (SF2), sub-frame 3 (SF3), sub-frame 4 (SF4), sub-frame 5 (SF5), sub-frame 6 (SF6), sub-frame 7-1 (SF7-1), sub-frame 7-2 (SF7-2), sub-frame 8-1 (SF8-1), sub-frame 8-2 (SF8-2), sub-frame 8-3 (SF8-3) and sub-frame 8-4 (SF8-4). A light emitting period for expressing a grayscale is allocated to each sub-frame, as shown in the bottom row in the table of FIG. 2.

In such an embodiment of a digital driving method, the unit frame is divided into a plurality of sub-frames, and the sub-frame is selectively turned on based on the video signal for the unit frame period to express the grayscale of the unit frame. In one exemplary embodiment, for example, the sub-frame 3 (SF3) having four light emitting periods for one frame and the sub-frame 4 (SF4) having eight light emitting periods may be turned on once to express the grayscale 12, the sub-frame 1 (SF1) to the sub-frame 7-2 (SF7-2) may be turned on for one frame period to express the gray level 127, the sub-frame 8-1 (SF8-1) to the sub-frame 8-4 (SF8-4) may be turned on for one frame period and to express the gray level 128.

In an exemplary embodiment, the data driver 30 provides a plurality of data signals to a plurality of data lines (DA1 to DAm) for the sub-frames (SF) of a unit frame based on the data control signal (DCS).

In such an embodiment, the data driver 30 is synchronized with a time when a scan signal having a corresponding turn-on voltage is supplied to each sub-frame (SF), and transmits the data signals for controlling light emitting states of the pixels 40 to the data lines (DA1 to DAm). The turn-on voltage means a voltage level for turning on a driving transistor (T2) for transmitting a current to the OLED, which will be described later in greater detail with reference to FIG. 3.

The scan driver 20 is synchronized with a starting point of each sub-frame (SF), and supplies a scan signal having a turn-on voltage to a corresponding scan line of the scan lines (S1 to Sn). The scan signal is set with a voltage (e.g., a high polarity voltage) for turning on the transistors. Pixels 40 connected to the corresponding scan line, to which the scan signal having the turn-on voltage, are selected by the scan signal. The pixels 40 selected by the scan signal receive the data signal from the data lines (DA1 to DAm) corresponding to a corresponding sub-frame. Herein, the corresponding sub-frame means a sub-frame that corresponds to the scan signal having the turn-on voltage.

In an exemplary embodiment, the first power (ELVDD) and the second power (ELVSS) are driving voltages for an operation of the pixels 40. In such an embodiment, the first power (ELVDD) may be a high-level driving voltage, and the second power (ELVSS) may be a low-level driving voltage.

Figure 3:
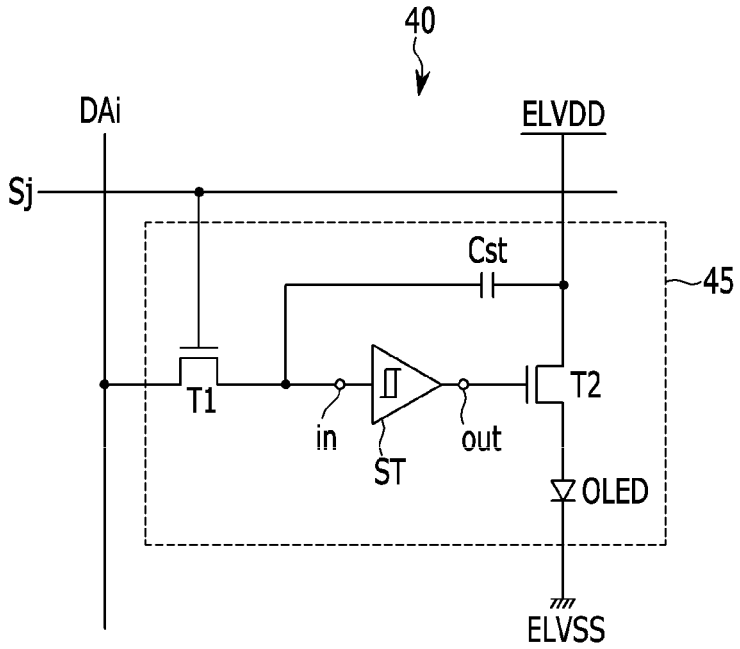
FIG. 3 is a circuit diagram showing an exemplary embodiment of a pixel circuit according to the invention.

FIG. 3 is a circuit diagram showing an exemplary embodiment of a pixel circuit according to the invention.

FIG. 3 shows a pixel circuit 45 of a pixel 40 connected to a corresponding scan line of the scan lines (S1 to Sn) and a corresponding data line of the data lines (DA1 to DAm) shown in FIG. 1. In such an embodiment, the corresponding scan line may be a j-th scan line (Sj) of the scan lines (S1 to Sn), and the corresponding data line may be an i-th data line (DAi) of the data lines (DA1 to DAm).

Referring to FIG. 3, the pixel circuit 45 controls a current amount supplied to the OLED based on the data signal supplied to the corresponding data line (DAi) when a scan signal is supplied to the corresponding scan line (Si). In an exemplary embodiment, the pixel circuit 45 includes a switching transistor (T1), a driving transistor (T2), a storage capacitor (Cst) and a threshold circuit (ST).

FIG. 3 shows one exemplary embodiment of the driving circuit of the pixel, but is not limited thereto, and the configuration of the pixel circuit may be variously modified based on other known configurations in the art.

In an exemplary embodiment, as shown in FIG. 3, a gate electrode of the switching transistor (T1) is connected to the corresponding scan line (Sj), and the first electrode is connected to the corresponding data line (Di). A second electrode of the switching transistor (T1) is connected to a first end of a storage capacitor (Cst). In such an embodiment, the first electrode may be one of a source electrode and a drain electrode, and the second electrode may be the other of the source electrode and the drain electrode. In one exemplary embodiment, for example, the first electrode is the drain electrode, and the second electrode is the source electrode. The switching transistor (T1) connected to the corresponding scan line (Sj) and the corresponding data line (Di) is turned on when the scan signal is provided by the corresponding scan line (Sj), and the switching transistor (T1) supplies the data signal provided by the corresponding data line (Di) to the storage capacitor (Cst) and the threshold circuit (ST). When the data signal is supplied to the storage capacitor (Cst), the storage capacitor (Cst) charges a voltage that corresponds to the data signal.

A gate electrode of the driving transistor (T2) is connected to an output terminal (out) of the threshold circuit (ST), and the first electrode is connected to a second end of the storage capacitor (Cst) and the first power (ELVDD). A second electrode of the driving transistor (T2) is connected to an anode electrode of the OLED. The driving transistor (T2) is turned on by an output voltage of the threshold circuit (ST), and controls the current amount that flows to the second power (ELVSS) from the first power (ELVDD) through the OLED corresponding to the voltage value stored in the storage capacitor (Cst).

A first end of the storage capacitor (Cst) is connected to an input terminal (in) of the threshold circuit (ST), and a second of the storage capacitor (Cst) is connected to the first power (ELVDD) and the first electrode of the driving transistor (T2). The storage capacitor (Cst) charges the voltage that corresponds to the data signal.

Figure 4:
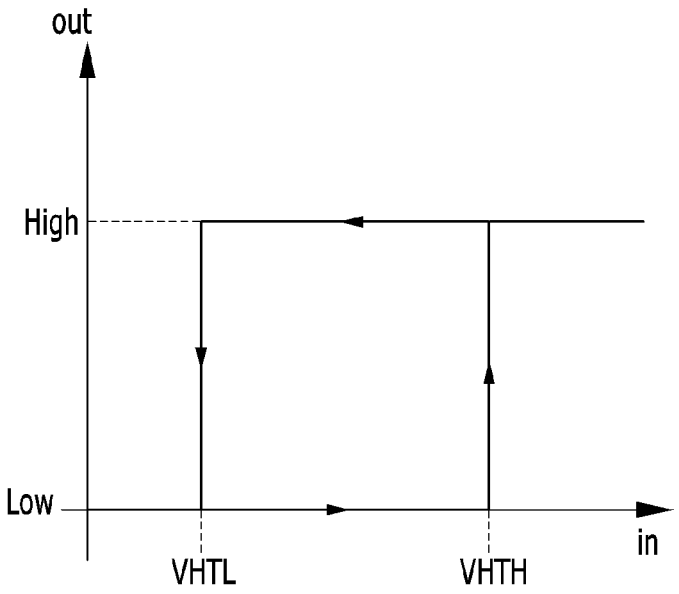
FIG. 4 is a graph showing an output characteristic of a threshold circuit.

FIG. 4 is a graph showing an output characteristic of a threshold circuit (ST).

The input terminal (in) of the threshold circuit (ST) is connected to the first end of the storage capacitor (Cst) and the output terminal (out) of the threshold circuit (ST) is connected to the gate electrode of the driving transistor (T2).

When an input voltage of the threshold circuit (ST) becomes greater than a predetermined value, the threshold circuit (ST) substantially instantly starts an operation to acquire a substantially constant output, and when the input voltage of the threshold circuit (ST) becomes less than the predetermined value, the threshold circuit (ST) substantially instantly restores the input voltage, which is called a hysteresis characteristic.

As shown in FIG. 4, the threshold circuit (ST) outputs a low-level voltage (Low) to the output terminal (out) when an input voltage of the input terminal (in) thereof is less than a second voltage (VHTH), and the threshold circuit (ST) outputs a high-level voltage (High) when the input voltage becomes greater than the second voltage (VHTH).

After the input voltage of the input terminal (in) of the threshold circuit (ST) has increased to be greater than the second voltage (VHTH), the threshold circuit (ST) outputs the high-level voltage (High) as long as the input voltage of the input terminal (in) thereof exceeds a first voltage (VHTL), and when the input voltage of the input terminal (in) thereof becomes less than the first voltage (VHTL), the threshold circuit (ST) outputs a low-level voltage (Low).

Therefore, the output of the threshold circuit (ST) is not influenced by noise such as a leakage current or a ripple generated by the switching transistor (T1), the threshold circuit (ST) outputs a substantially constant high-level voltage (High) or low-level voltage (Low), and the threshold circuit (ST) supplies the substantially constant high-level voltage (High) or low-level voltage (Low) to the gate electrode of the driving transistor (T2).

In an exemplary embodiment, the threshold circuit (ST) may include at least one of a Schmitt trigger, a threshold detector and a zero level detector, for example.

The anode of the OLED is connected to the drain electrode of the driving transistor (T2), and a cathode of the OLED is connected to the second power (ELVSS). The OLED emits light based on a driving current that flows through the driving transistor (T2).

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A pixel circuit comprising:

an organic light emitting diode;

a threshold circuit which generates an output signal based on an input signal, wherein the threshold circuit has a hysteresis characteristic with respect to the input signal;

a first transistor comprising a first electrode connected to a data line, a second electrode connected to an input terminal of the threshold circuit, and a gate electrode connected to a scan line;

a second transistor comprising a first electrode connected to a driving voltage, a second electrode connected to an anode of the organic light emitting diode, and a gate electrode connected to an output terminal of the threshold circuit, wherein the second transistor controls a current amount which flows to the organic light emitting diode from the driving voltage based on the output signal of the threshold circuit; and a storage capacitor comprising a first end electrically and directly connected to the input terminal of the threshold circuit, and a second end connected to the first electrode of the second transistor.

2. The pixel circuit of claim 1, wherein the threshold circuit outputs a low-level voltage when a voltage of the input signal is less than a second voltage, and the threshold circuit outputs a high-level voltage when the voltage of the input signal is greater than the second voltage.

3. The pixel circuit of claim 2, wherein the threshold circuit outputs the high-level voltage when the voltage of the input signal exceeds a first voltage after the voltage of the input signal is increased to be greater than the second voltage, and the threshold circuit outputs the low-level voltage when the voltage of the input signal is less than the first voltage.

4. The pixel circuit of claim 1, wherein the threshold circuit comprises at least one of a Schmitt trigger, a threshold detector and a zero level detector.

5. A display device comprising:

a scan driver which generates a scan signal and supplies the scan signal to a scan line;

a data driver which generates a data signal and supplies the data signal to a data line;

a display panel comprising a pixel circuit connected to the scan line and the data line; and a controller which controls the scan driver and the data driver, wherein the pixel circuit comprises:

an organic light emitting diode;

a threshold circuit which generates an output signal based on an input signal, wherein the threshold circuit has a hysteresis characteristic with respect to an input signal;

a first transistor comprising a first electrode connected to the data line, a second electrode connected to an input terminal of the threshold circuit, and a gate electrode connected to the scan line, a second transistor comprising a first electrode connected to a driving voltage, a second electrode connected to an anode of the organic light emitting diode, and a gate electrode connected to an output terminal of the threshold circuit, wherein the second transistor controls a current amount which flows to the organic light emitting diode from the driving voltage based on the output signal of the threshold circuit and a storage capacitor comprising a first end electrically and directly connected to the input terminal of the threshold circuit, and a second end connected to the first electrode of the second transistor.

6. The display device of claim 5, wherein the threshold circuit outputs a low-level voltage when a voltage of the input signal is less than a second voltage, and the threshold circuit outputs a high-level voltage when the voltage of the input signal is greater than the second voltage.

7. The display device of claim 6, wherein the threshold circuit outputs a high-level voltage when the voltage of the input signal exceeds the first voltage after the voltage of the input signal is increased to be greater than the second voltage, and the threshold circuit outputs a low-level voltage when the voltage of the input signal becomes less than the first voltage.

8. The display device of claim 5, wherein the threshold circuit comprises at least one of a Schmitt trigger, a threshold detector and a zero level detector.

9. A method of driving a display device, the method comprising:

outputting a low-level voltage from a threshold circuit of a pixel circuit of the display device when a voltage of an input signal to the threshold circuit is less than a second voltage; and outputting a high-level voltage from the threshold circuit when a voltage of the input signal to the threshold circuit becomes greater than the second voltage, wherein the pixel circuit comprises:

an organic light emitting diode;

the threshold circuit which generates an output signal based on the input signal, wherein the threshold circuit has a hysteresis characteristic with respect to the input signal;

a first transistor comprising a first electrode connected to a data line of the display device, a second electrode connected to an input terminal of the threshold circuit, and a gate electrode connected to a scan line of the display device;

a second transistor comprising a first electrode connected to a driving voltage, a second electrode connected to an anode of the organic light emitting diode, and a gate electrode connected to an output terminal of the threshold circuit, wherein the second transistor controls a current amount which flows to the organic light emitting diode from the driving voltage based on the output signal of the threshold circuit, and a storage capacitor comprising a first end electrically and directly connected to the input terminal of the threshold circuit, and a second end connected to the first electrode of the second transistor.

10. The method of claim 9, further comprising:

outputting the high-level voltage from the threshold circuit when the voltage of the input signal exceeds a first voltage after the voltage of the input signal is increased to be greater than the second voltage; and outputting the low-level voltage from the threshold circuit when the voltage of the input signal is less than the first voltage.

* * * * *